US008715430B2

(12) United States Patent
Hara et al.

(10) Patent No.: US 8,715,430 B2
(45) Date of Patent: May 6, 2014

(54) HIGH STRENGTH STEEL PLATE AND HIGH STRENGTH WELDED PIPE EXCELLENT IN DUCTILE FRACTURE CHARACTERISTIC AND METHODS OF PRODUCTION OF SAME

(75) Inventors: Takuya Hara, Futtsu (JP); Yasuhiro Shinohara, Futtsu (JP); Hitoshi Asahi, Futtsu (JP); Yoshio Terada, Kimitsu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 975 days.

(21) Appl. No.: 11/887,885

(22) PCT Filed: Apr. 19, 2005

(86) PCT No.: PCT/JP2005/007756

§ 371 (c)(1),
(2), (4) Date: Nov. 29, 2007

(87) PCT Pub. No.: WO2006/106591

PCT Pub. Date: Oct. 12, 2006

(65) Prior Publication Data

US 2009/0025835 A1 Jan. 29, 2009

(30) Foreign Application Priority Data

Apr. 4, 2005 (JP) ..... 2005-107193

(51) Int. Cl.
*C22C 38/00* (2006.01)

(52) U.S. Cl.
USPC ..... 148/337; 148/521; 148/336; 148/307

(58) Field of Classification Search
USPC ..... 148/593, 337, 521, 336, 307
IPC ..... C21D 8/02
See application file for complete search history.

(56) References Cited

U.S. PATENT DOCUMENTS 6,866,725 B2 * 3/2005 Fujita et al. ..... 148/320

FOREIGN PATENT DOCUMENTS

| | | | |
|---|---|---|---|
| EP | 0 757 113 | A1 | 2/1997 |
| EP | 1 020 539 | A2 | 7/2000 |
| EP | 1 777 316 | A1 | 4/2007 |
| JP | 10-147846 | A | 6/1998 |
| JP | 11-036042 | | 2/1999 |
| JP | 11-140580 | | 5/1999 |
| JP | 11-343542 | A | 12/1999 |
| JP | 2002-285283 | A | 10/2002 |
| JP | 2003-96517 | A | 4/2003 |
| JP | 2003-293078 | | 10/2003 |

* cited by examiner

*Primary Examiner* — Weiping Zhu
(74) *Attorney, Agent, or Firm* — Kenyon & Kenyon LLP

(57) ABSTRACT

The present invention provides high strength steel plate and high strength welded pipe excellent in ductile fracture characteristic and methods of production of the same, that is, high strength steel plate excellent in ductile fracture characteristic, and high strength welded pipe using that steel plate as a base material, having a tensile strength corresponding to the X100 class of the API standard, containing, by mass %, C: 0.01 to 0.5%, Si: 0.01 to 3%, Mn: 0.1 to 5%, P: 0.03% or less, and S: 0.03% or less and a balance of Fe and unavoidable impurities, having a microstructure comprised of, by area ratio, 1 to 60% of ferrite and the balance of bainite and martensite, having a maximum value of the {100} accumulation degree of the cross-section rotated 20 to 50° from the plate thickness cross-section about the rolling direction as an axis of 3 or less, and having plate thickness parallel cracks measured by ultrasonic flaw detection of less than 1 mm.

8 Claims, 2 Drawing Sheets

HIGH STRENGTH STEEL PLATE AND HIGH STRENGTH WELDED PIPE EXCELLENT IN DUCTILE FRACTURE CHARACTERISTIC AND METHODS OF PRODUCTION OF SAME

TECHNICAL FIELD

The present invention relates to high strength steel plate and high strength welded pipe excellent in ductile fracture characteristic having a tensile strength (TS) of 760 MPa to less than 900 MPa suitable for line pipe etc. transporting natural gas and crude oil.

BACKGROUND ART

In recent years, in crude oil and natural gas pipelines, increase of the internal pressure for the purpose of improving the transport efficiency and reduction of the outer diameter and weight of line pipe for the purpose of improving the efficiency of on-site installation have been demanded. High strength steel pipe with a tensile strength in the circumferential direction or 760 MPa to less than 900 MPa, corresponding to the X100 class of the API standard, has been developed (for example, Japanese Patent Publication (A) No. 11-140580 and Japanese Patent Publication (A) No. 2003-293078).

Further, in pipelines, a ductile crack occurring in the base material of the steel pipe may propagate in the pipe axial direction at a high speed of 100 m/s or more over a long distance of 100 meters to several km. An arrest characteristic is therefore demanded. The "arrest characteristic" is the characteristic of arresting the propagation of cracks. It is classified into the characteristic of arresting the propagation of an embrittlement crack through the base material, that is, the embrittlement fracture resistance characteristic, and the characteristic of arresting the propagation of a ductile crack through the base material, that is, the ductile fracture characteristic. Among these, for the embrittlement fracture resistance characteristic, a structural steel material with the (211) planes accumulated at the rolled surface to improve the embrittlement crack propagation arrest characteristic has been proposed (for example, Japanese Patent Publication (A) No. 2002-24891).

The embrittlement fracture resistance characteristic is evaluated by running a drop weight tear test (referred to as a "DWTT test") and determining the temperature at which the ductile fracture rate becomes 85% or more (referred to as the "DWTT transition temperature"). In particular, embrittlement cracks often occur from the weld zones, so it is possible to form the weld bead at the center of a test piece, introduce an embrittlement crack, and run a DWTT test for evaluation. Steel pipe excellent in this type of embrittlement fracture resistance characteristic has been proposed (for example, Japanese Patent Publication (A) No. 11-36042).

On the other hand, for the evaluation of the ductile fracture characteristic, a full crack burst test which attaches an explosive to the surface of the steel pipe, explodes it, and judges if the ductile crack formed is arrested is optimal. However, a full crack burst test is extremely high in the costs required for the test, so is being replaced by the Charpy impact test or DWTT test. This is because the results of a full crack burst test and the Charpy absorption energy or absorption energy found by the DWTT test (referred to as the "DWTT absorption energy") match relatively well for steel with a tensile strength of up to the X70 class or so.

However, in high strength steel plate and high strength welded pipe with a tensile strength of the X100 class or more, it was learned that no correlation can be observed between the full crack burst test of steel pipe and the Charpy absorption energy and DWTT absorption energy of the material, that is, the steel plate. It was learned that the Charpy impact test and DWTT test are not suitable for evaluation of the ductile fracture characteristic of high strength steel plate. For this reason, in place of the high test cost full crack burst test of steel pipe, a test method enabling simple evaluation of the ductile fracture characteristic is required. Further, use of the findings obtained by this test so as to develop high strength steel plate and high strength welded pipe excellent in ductile fracture characteristic has been demanded.

Further, in high strength steel plate and high strength welded pipe corresponding to the X100 class, defects known as "surface parallel cracks" sometimes occur. In the present invention, "surface parallel cracks" are cracks parallel to the plate surface which in particular easily occur in the vicinity of the center of the steel plate in the plate thickness and are defects caused by hydrogen. These surface parallel cracks can be detected by ultrasonic flaw detection. High strength steel plate and high strength welded pipe are high in hydrogen-induced crack susceptibility, so sometimes surface parallel cracks are present and the ductile fracture characteristic deteriorates.

DISCLOSURE OF THE INVENTION

The present invention provides high strength steel plate and high strength welded pipe excellent in ductile fracture characteristic with a tensile strength corresponding to the X100 class of the API standard and methods of production of the same. Note that a "steel plate or steel pipe with a tensile strength corresponding to the X100 class of the API standard" is one with a tensile strength in the width direction of the steel plate or circumferential direction of the steel pipe of 760 MPa to less than 900 MPa in range.

The inventors studied a simple test method able to suitably evaluate the ductile fracture characteristic of high strength welded pipe with a tensile strength in the circumferential direction of 760 MPa to less than 900 MPa and, based on the obtained discoveries, further studied the ingredients, microstructure, and texture of the base material for obtaining high strength welded pipe excellent in ductile fracture characteristic. As a result, they obtained the discovery that it is effective to optimize the microstructure and texture of the base material, that is, steel plate, further studied the production conditions, and invented high strength steel plate and high strength welded pipe excellent in ductile fracture characteristic and methods of production of the same. The gist of the present invention is as follows:

(1) A high strength steel plate excellent in ductile fracture characteristic, characterized by containing, by mass %, C: 0.01 to 0.5%, Si: 0.01 to 3%, Mn: 0.1 to 5%, P: 0.03% or less, and S: 0.03% or less and a balance of Fe and unavoidable impurities, having a microstructure containing, by area ratio, 1 to 60% of ferrite and comprising a balance of bainite and martensite, having a maximum value of a {100} accumulation degree of a cross-section rotated 20 to 50° from a plate thickness cross-section about the axis of the rolling direction of 3 or less, and having thickness parallel cracks measured by ultrasonic flaw detection of less than 1 mm.

(2) A high strength steel plate excellent in ductile fracture characteristic as set forth in (1), characterized by further containing, by mass %, Ni: 0.1 to 2%, Mo: 0.15 to 0.6%, Nb: 0.001 to 0.1%, and Ti: 0.005 to 0.03%.

(3) A high strength steel plate excellent in ductile fracture characteristic as set forth in (1) or (2), characterized by further containing, by mass %, one or more of Al: 0.06% or less, B:

0.0001 to 0.005%, N: 0.0001 to 0.006%, V: 0.001 to 0.1%, Cu: 0.01 to 1%, Cr: 0.01 to 0.8%, Zr: 0.0001 to 0.005%, Ta: 0.0001 to 0.005%, Ca: 0.0001 to 0.01%, REM: 0.0001 to 0.01%, and Mg: 0.0001 to 0.006%.

(4) A high strength steel plate excellent in ductile fracture characteristic as set forth in any one of (1) to (3), characterized in that an average grain size of the ferrite is 5 μm or less.

(5) A high strength steel plate excellent in ductile fracture characteristic as set forth in any one of (1) to (4), characterized in that the {100} accumulation degree of the rolled surface is 1.6 to 7.

(6) A high strength steel plate excellent in ductile fracture characteristic as set forth in any one of (1) to (5), characterized in that the tensile strength TS is 760 to less than 900 MPa, a precrack DWTT energy E at −20° C. is 3000 to 9000 J, and TS and E satisfy the following equation (1):

$$20000 \leq 20TS+E \leq 25000 \quad (1)$$

(7) A high strength welded pipe excellent ductile fracture characterized in that its base material is comprised of a high strength steel plate excellent in ductile fracture characteristic as set forth in any one of (1) to (6).

(8) A high strength welded pipe excellent ductile tear as set forth in (7) characterized in that the seam welding metal contains as ingredients, by mass %, C: 0.04 to 0.14%, Si: 0.05 to 0.4%, Mn: 1.2 to 2.2%, P: 0.01% or less, S: 0.01% or less, Ni: 1.3 to 3.2%, Cr+Mo+V: 1 to 2.5%, and O: 0.01 to 0.06% and further one or more of Ti: 0.003 to 0.05%, Al: 0.02% or less, and B: 0.005% or less and a balance of Fe and unavoidable impurities.

(9) A method of production of high strength steel plate excellent in ductile fracture characteristic as set forth in any one of (1) to (6) comprising the steps of producing steel comprised of the ingredients as set forth in any one of (1) to (3), continuously casting it to form a steel slab, reheating the steel slab, rolling it by recrystallization rolling and nonrecrystallization rolling, then water cooling it, said method of production of steel plate characterized in that the end temperature of the noncrystallization rolling is 600 to 800° C., a cumulative rolling ratio at under 800° C. is 10% or more, an average cooling rate from 600° C. to 450° C. at the center of the steel plate at the time of water cooling is 0.5 to 10° C./s, and a water cooling stop temperature is over 350° C.

(10) A method of production of high strength steel plate excellent in ductile fracture characteristic as set forth in (9) characterized in that the reheating temperature of the steel slab is 1100 to 1250° C.

(11) A method of production of high strength steel plate excellent in ductile fracture characteristic as set forth in (9) or (10) characterized in that an average value of the rolling ratio at the different rolling passes at 900° C. or more in the recrystallization rolling is 5% or more and the rolling ratio of the final pass is 10% or more.

(12) A method of production of high strength steel plate excellent in ductile fracture characteristic as set forth in any one of (9) to (12) characterized in that the cumulative rolling ratio at 880° C. or less in the nonrecrystallization rolling is 60% or more.

(13) A method of production of high strength welded pipe excellent in ductile fracture characteristic as set forth in (7), said method of production of high strength welded pipe excellent in ductile fracture characteristic characterized by shaping a high strength steel plate excellent in ductile fracture characteristic as set forth in any of (1) to (6) into a pipe shape by a UO process, welding together the ends by submerged arc welding using welding wire and sintered flux or molten flux, then expanding the pipe.

(14) A method of production of high strength welded pipe excellent in ductile fracture characteristic as set forth in (8), said method of production of high strength welded pipe excellent in ductile fracture characteristic characterized in that the welding wire contains as ingredients, by mass %, C: 0.01 to 0.12%, Si: 0.3% or less, Mn: 1.2 to 2.4%, Ni: 4 to 8.5%, and Cr+Mo+V: 3 to 5% and, further, one or both of Ti: 0.005 to 0.15% and Al: 0.02% or less and a balance of Fe and unavoidable impurities.

(15) A method of production of high strength welded pipe excellent in ductile fracture characteristic as set forth in (13) or (14), characterized in that a specific heat input per 1 mm plate thickness of the submerged arc welding is 0.13 to 0.25 kJ/mm$^2$.

BEST MODE FOR CARRYING OUT THE INVENTION

Figure 1:
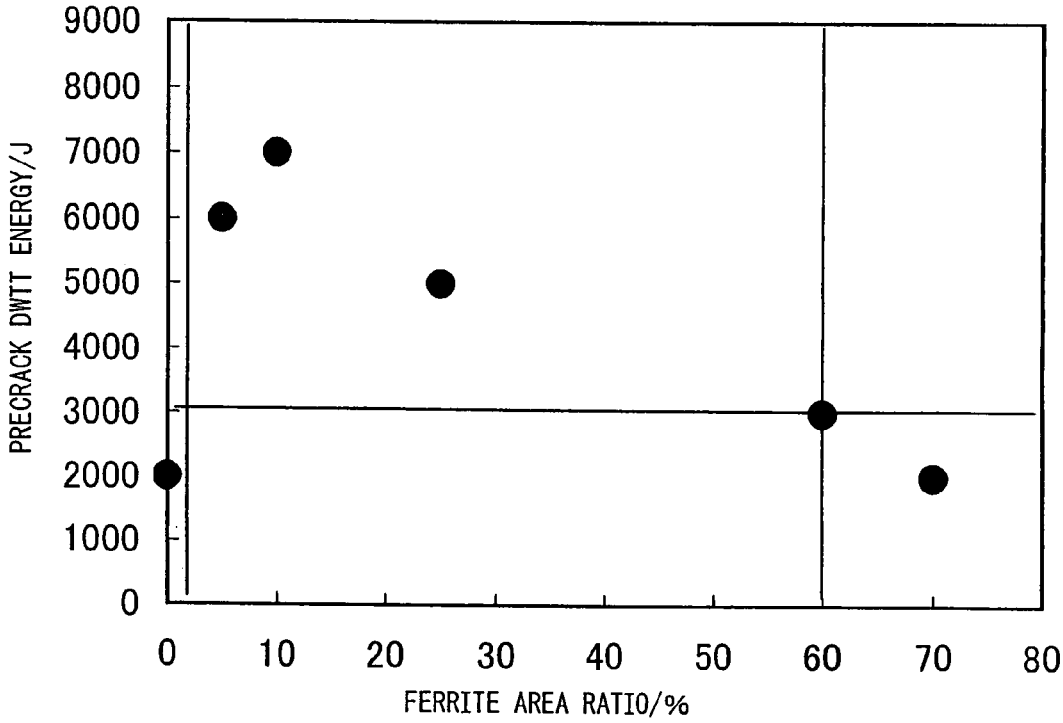
FIG. 1 is a view of the relationship between the area ratio of ferrite of steel plate and the precrack DWTT energy.

First, the inventors studied a method of evaluation of the ductile fracture characteristic of high strength steel plate able to take the place of the full burst test of high strength welded pipe. The ductile fracture characteristic is a characteristic by which a propagating crack is arrested, so it was considered there might be a correlation with the energy of propagation of the crack. Therefore, the inventors used various steel materials, found the load-displacement curve in the Charpy impact test, and evaluated the energy of formation of a crack and the energy of propagation separately. As a result, the inventors learned that with high strength steel with a tensile strength of 760 MPa or more, the energy of formation of a crack is much larger than the energy of propagation. That is, the absorption energy measured by the Charpy impact test is a test simultaneously evaluating the energy of formation and propagation of a crack. The inventors learned that this is not suitable for evaluation of the ductile fracture characteristic which has a large correlation with the energy of propagation of a crack. Note that the inventors obtained findings similar to a Charpy impact test even with a DWTT test.

Next, the inventors studied the test method for suitably evaluating the energy of propagation of a crack. The inventors took note of the fact that a crack occurring in a full crack burst test proceeds in the longitudinal direction of the steel pipe along a cross-section rotated 20 to 50° from the thickness cross-section about the axis of the longitudinal direction of the steel pipe. That is, in steel plate, a crack proceeds along the cross-section rotated 20 to 50° from the plate thickness cross-section about the axis of the rolling direction of the steel plate. Note that the cross-section rotated 20 to 50° from the thickness cross-section about the axis of the longitudinal direction of the steel pipe and the cross-section rotated 20 to 50° from the plate thickness cross-section about the axis of the rolling direction of the steel plate are together referred to as the "45° plane". From the above discovery, the inventors considered that for evaluation of the energy of propagation of a crack of steel plate, it would be optimal to use a test piece where the crack would easily proceed along the 45° plane, that is, a DWTT test piece with a large ratio of the plate width direction to the plate thickness direction. Further, to sharpen the front end of the notch and lower the energy for formation of a crack, the inventors studied introducing a press notch applying pressure to a wedge shaped jig and introducing a ductile crack by three-point bending.

As a result, the inventors learned that when introducing a press notch to the center of a test piece and applying a load to the center at the opposite side to the press notch and at the two ends at the press notch side for three-point bending, if, after reaching the maximum load, stopping at the point of time when the load falls to 5% of the maximum load and using a test piece in which a ductile crack has been introduced to run a DWTT test (below, referred to as a "precrack DWTT test"), it is possible to suitably evaluate the energy of propagation of a crack by the obtained absorption energy (referred to as the "precrack DWTT energy").

Based on this discovery, the inventors ran precrack DWTT tests on various types of steel plate and studied the factors for the improvement of the ductile fracture characteristic of the steel plate. First, to clarify the relationship between the precrack DWTT energy and microstructure of 0.06C-2Mn—Ni—Cu—Cr—Mo—Ti based steel plate, they investigated the relationship between the area ratio of ferrite of the steel plate and the precrack DWTT energy at −20° C. As a result, as shown in FIG. 1, they learned that if the area ratio of ferrite of the microstructure is 1 to 60%, the precrack DWTT energy at −20° C. is improved to 3000 J or more. Note that the area ratio of ferrite of steel plate is found by image analysis of an optical micrograph of the structure of the plate thickness cross-section of the steel plate.

Figure 2:
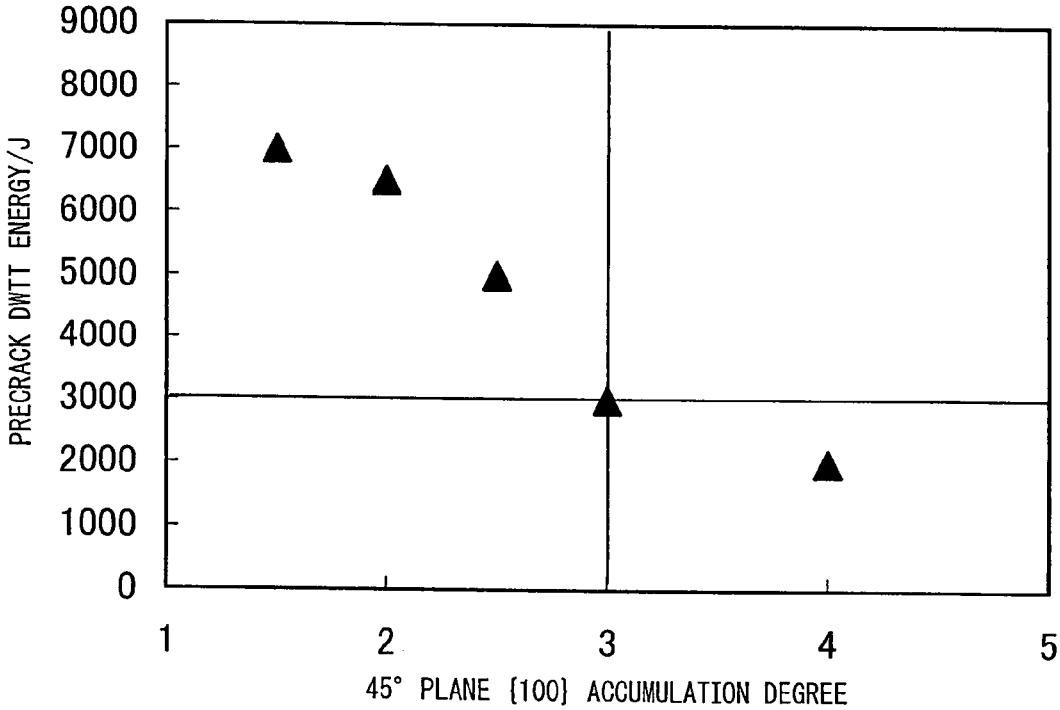
FIG. 2 is a view of the relationship between the {100} accumulation degree of the 45° plane of steel plate and the precrack DWTT energy.

Further, the inventors investigated the texture of the cross-section rotated 20 to 50° from the plate thickness cross-section about the axis of the rolling direction of the steel plate and studied the relationship between the maximum value and the precrack DWTT energy. As a result, as shown in FIG. 2, they learned that if the maximum value of the {100} accumulation degree of the cross-section rotated 20 to 50° from the plate thickness cross-section about the axis of the rolling direction (referred to as the "{100} accumulation degree of the 45° plane") becomes 3 or more, the precrack DWTT energy remarkably falls. Note that the {100} accumulation degree evaluates the measurement value of the strength of the sample by X-ray diffraction divided by the measurement value of the strength of a standard sample having a random orientation by X-ray diffraction. That is, the {100} accumulation degree being 3 means that the measured value of the strength of {100} X-ray diffraction is 3 times the measured value of the standard sample having random orientation. Note that {100} shows together the equivalent (100) crystal planes.

The reason why if the {100} are accumulated at the 45° plane of the steel plate, the precrack DWTT energy remarkably falls is believed to be as follows: A crack of a ductile fracture theoretically proceeds along a plane rotated 45° from the plate thickness cross-section about the axis of the rolling direction of the steel plate, that is, in the rolling direction inclined 45° from the plate thickness direction. Therefore, if the {100} corresponding to the cleavage surface of the steel are accumulated at the 45° plane of the steel plate, the plane of progression of the crack and the cleavage surface will match, so if an embrittlement fracture happens to occur at the 45° plane of the steel plate, the crack will probably propagate all at once. Note that theoretically the {100} accumulation degree at the plane rotated 45° from the plate thickness cross-section about the axis of the rolling direction becomes maximum, but if actually measuring this, often the {100} accumulation degree near the plane rotated 40° becomes the maximum.

Next, the inventors observed the microstructure at the parts where {100} accumulated at the 45° plane of the steel plate and as a result learned that it was mainly bainite and martensite. In general, when performing hot rolling in the nonrecrystallization temperature range (referred to as "nonrecrystallization rolling"), austenite is transformed into bainite and martensite at the time of cooling and the {100} easily accumulate at the 45° plane of the steel plate. On the other hand, with nonrecrystallization rolled ferrite, the {100} easily accumulate at a plane parallel to the surface of the steel plate, that is, the rolled surface. Therefore, if the ferrite fraction at the time of nonrecrystallization rolling increases, the {100} accumulation degree of the 45° plane of the steel plate tends to fall. Further, if the {100} accumulation degree of the rolled surface of the steel plate increases, the cleavage surface where a crack easily propagates increases in a direction along the rolled surface as well, so separation easily occurs. In general, the occurrence of separation damages the toughness, but compared with the case where no separation occurs, the inventors learned that the occurrence of separation resulted in the drop in the precrack DWTT energy being remarkably suppressed.

Figure 3:
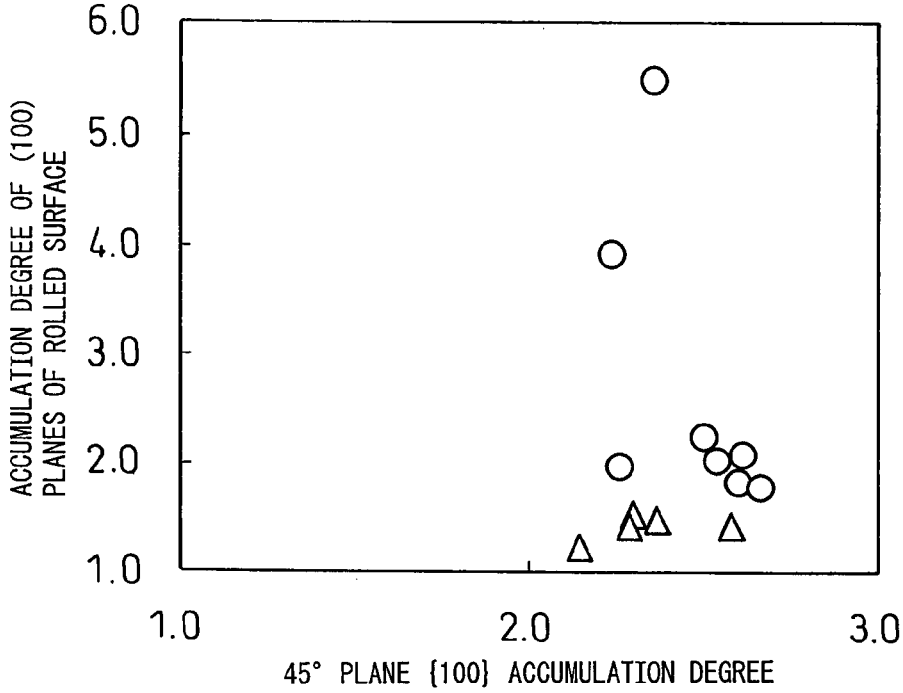
FIG. 3 is a view of the relationship between the {100} accumulation degree of the 45° plane of steel plate and the fracture mode.

Further, the inventors investigated the {100} accumulation at the rolled surface of the steel plate by X-ray diffraction for various steel plate having a {100} accumulation degree of the 45° plane of steel plate of 3 or less and a tensile strength of the X100 class. The relationship between the {100} accumulation degree of the 45° plane and the rolled surface of steel plate and the separation is shown in FIG. 3. The {100} accumulation degree of the rolled surface of steel plate was measured by X-ray diffraction using a test piece taken from the center of plate thickness so the measurement surface became parallel to the surface of the steel plate. FIG. 3 shows the relationship between the (100) accumulation degree of the 45° plane of steel plate, the {100} accumulation degree of the rolled surface of the steel plate, and the fracture mode. Note that the (100) accumulation degree of the 45° plane was found by performing X-ray diffraction using the plane rotated 20 to 50° from the plate thickness cross-section about the axis of the rolling direction as the measurement surface. The maximum value was employed. Note that the {100} accumulation degree of the plane rotated 40° from the plate thickness cross-section about the axis of the rolling direction was the largest. Further, in FIG. 3, ○ means remarkable occurrence of separation, while Δ indicates almost no occurrence of separation recognized.

In FIG. 3, Δ indicates that the {100} accumulation degree of the rolled surface is less than 1.6 and the occurrence of separation is not remarkable. On the other hand, □ indicates that the {100} accumulation degree of the rolled surface is 1.6 or more and occurrence of separation is remarkable. Therefore, it is learned that if the {100} accumulation degree of the rolled surface becomes 1.6 or more, the occurrence of separation becomes remarkable.

Figure 4:
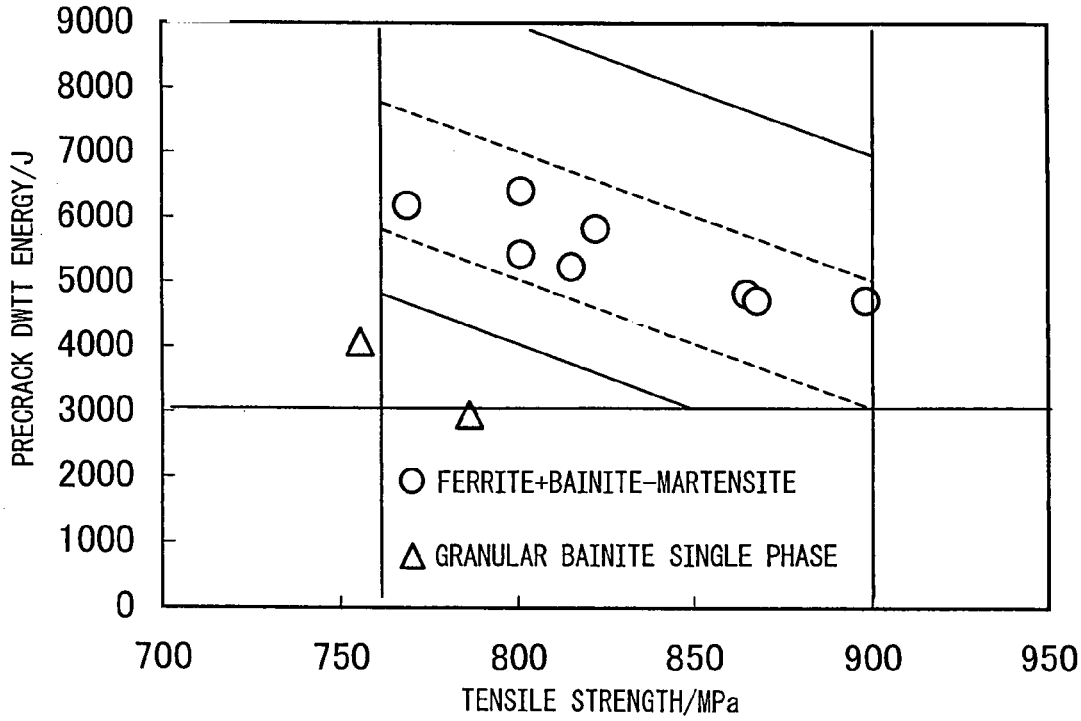
FIG. 4 is a view of the relationship between the microstructure and tensile strength of steel plate and the precrack DWTT energy.

The inventors engaged in further study and studied the effects of the microstructure on the correlation between the tensile strength TS and the precrack DWTT energy E at −20° C. The results are shown in FIG. 4. Note that in FIG. 4, the tensile strength is in the width direction of the steel plate corresponding to the circumferential direction of steel pipe. From FIG. 4, in the range where the tensile strength is 760 MPa to less than 900 MPa, it is learned that when compared by the same extent of tensile strength, steel having a microstructure comprised of the two phases of ferrite and bainite-martensite has a higher precrack DWTT energy than even steel where the microstructure is a single phase of granular bainite. In FIG. 4, the solid line E is 3000 to 9000 J and shows a range satisfying 20000≤20TS+E≤25000. Note that the broken line is the range of 21000≤20TS+E≤23000.

Further, the material of high strength welded pipe, that is, high strength steel plate, sometimes is formed with surface parallel cracks parallel to the plate surface near the center of plate thickness. Surface parallel cracks are due to hydrogen, lower the precrack DWTT energy, and impair the ductile fracture characteristic. The occurrence of surface parallel cracks is correlated with the water cooling stop temperature. If the water cooling stop temperature is over 350° C., the inventors learned that it is possible to substantially prevent the occurrence of surface parallel cracks. Note that the occurrence of surface parallel cracks can be confirmed by obtaining a 300 mm square test piece from steel plate after rolling and performing ultrasonic fault detection based on JIS Z 2344 at a frequency of 5 MPa by vertical fault detection. That is if the result of the ultrasonic fault detection is that the surface parallel cracks are less than 1 mm, the size of the fault is less than the detection limit. It is possible to confirm that the occurrence of surface parallel cracks can be substantially prevented.

Note that the inventors cut a steel pipe, pressed it into a flat plate shape, obtained a test piece from it, and used it to investigate the texture and microstructure of the base material of the steel pipe in the same way as with steel plate and measure the tensile strength and precrack DWTT energy at −20° C. Steel pipe is usually produced using the rolling direction of the steel pipe as the longitudinal direction of the steel pipe, so the circumferential direction of the steel pipe corresponds to the plate thickness cross-section of the steel pipe in the width direction of the steel plate. As a result, the inventors confirmed that the characteristics of the base material of the steel pipe pressed to a flat plate shape are substantially the same as those of the material, that is, the steel plate, and that the discoveries of steel plate can also be applied as they are to steel pipe.

Below, the high strength steel plate and high strength welded pipe of the present invention will be explained in detail.

If the area ratio of the ferrite is less than 1%, the precrack DWTT energy falls, while if over 60%, the tensile strength falls. If considering the balance between the tensile strength and ductile fracture characteristic, the area ratio of ferrite is preferably over 5% to 20%. Note that the microstructure other than the ferrite is a mixed structure of bainite and martensite (referred to as "bainite-martensite"). The ferrite and the bainite-martensite of the microstructure can be judged by observation of the structure using an optical microscope or a scan electron microscope. Further, the area ratio of ferrite can be measured by image analysis of a photograph of the structure obtained by an optical microscope or a scan electron microscope.

If the maximum value of the {100} accumulation degree at the plane rotated 20 to 50° from the plate thickness cross-section about the axis of the rolling direction of the steel plate ({100} accumulation degree of 45° plane) is over 3, the ductile fracture characteristic remarkably falls, so it is made 3 or less. The lower limit is made 1 corresponding to a random orientation. Note that the {100} accumulation degree of the 45° plane is found by performing X-ray diffraction using the plane rotated 20 to 50° from the plate thickness cross-section about the axis of the rolling direction as the measurement surface and finding the maximum value, but it is also possible to measure the {100} accumulation degree of the planes rotated at 5° intervals in the range of 20 to 50° from the plate thickness cross-section and find the maximum value.

Faults parallel to the rolled surface of the steel plate, that is, surface parallel cracks, reduce the precrack DWTT energy, so the surface parallel cracks as measured by ultrasonic flaw detection have to be less than 1 mm. Detection by ultrasonic flaw detection may be performed in accordance with JIS Z 2344. Note that the detection limit of surface parallel cracks by ultrasonic flaw detection is less than 1 mm, so if the measurement value is less than 1 mm, there are in fact no surface parallel cracks present at the steel plate.

If the average grain size of the ferrite exceeds 5 μm and becomes coarse, the unit of fracture surface of the fracture will become larger and the propagation energy will sometimes drop, so it is preferably 5 μm or less. Further, if the average grain size of the ferrite is 5 μm or less, the fine ferrite will disperse and will not form a layered shape. The average grain size of the ferrite can be measured by the slicing method using a structural photograph obtained by an optical microscope or scan electron microscope. The smaller the average grain size of the ferrite, the better, but making it less than 1 μm results in the production costs rising. Therefore, under the present conditions, the lower limit of the ferrite average grain size is 1 μm.

The {100} accumulation degree at the rolled surface of the steel plate is preferably made 1.6 or more so as to suppress the drop in the precrack DWTT energy due to the occurrence of separation. Further, to suppress a drop in the precrack DWTT energy, the {100} accumulation degree at the rolled surface of the steel plate is preferably made 1.8 or more. 2 or more is optimal. However, if the {100} accumulation degree at the rolled surface of the steel plate is over 7, the drop in the precrack DWTT energy due to separation becomes remarkable. Note that the upper limit of the {100} accumulation degree at the rolled surface of the steel plate is preferably made 3.5 or less if considering the drop in low temperature toughness due to separation.

The high strength steel of the present invention plate having the above microstructure and texture is superior in the tensile strength and ductile fracture characteristic, has a tensile strength of 760 MPa to less than 900 MPa, and has a precrack DWTT energy of 3000 J or more. Further, the high strength steel of the present invention is superior in balance of tensile strength TS and precrack DWTT energy E, has an E of 3000 to 9000 J, and satisfies 20000≤20TS+E≤25000. Note that the relationship of TS and E preferably satisfies 21000≤20TS+E.

Next, the reasons for limitation of the chemical ingredients of the base material will be explained.

C is an element extremely effective for improving the strength of the steel. Addition of 0.01% or more is necessary. Inclusion of 0.02% or more of C is preferable. However, if the C content is greater than 0.5%, the low temperature toughness of the base material and heat affected zone (referred to as the "HAZ") deteriorate and the on-site weldability is impaired, so the upper limit of the C content has to be made 0.5 or less. Note that to improve the low temperature toughness, the upper limit of the C content is preferably made 0.14% or less, more preferably the upper limit is 0.1% or less.

Si is an element effective for deoxidation. Inclusion of 0.01% or more is necessary. However, if adding over 3% of Si, the low temperature toughness of the HAZ will deteriorate and the on-site weldability will be impaired, so the upper limit of the amount of addition has to be made 3%, preferably the upper limit of the Si content is 0.6% or less.

Mn is an element effective for improving the balance between the strength and low temperature toughness of the steel. Addition of 0.1% or more is necessary and addition of 1.5% or more is preferable. On the other hand, if including Mn in excess, the hardenability of the steel will increase, the low temperature toughness of the HAZ will be degraded, and further the on-site weldability will be impaired. Therefore, the upper limit of the amount of addition of Mn has to be made 5% or less, preferably the upper limit is 2.5% or less.

P, S are impurity elements. To further improve the low temperature toughness of the base material and HAZ, the upper limits of the content of the P and the content of the S have to be made 0.03% or less and 0.03% or less, more preferably 0.015% or less and 0.003% or less. The lower limits of the content of P and the content of S are preferably as low as possible, so while not prescribed, usually 0.001% or more and 0.0001% or more are contained.

Further, Ni, Mo, Nb, and Ti may also be included.

Ni is an element improving the low temperature toughness and strength. The lower limit of the Ni content is preferably made 0.1% or more. On the other hand, if the content of Ni exceeds 2%, the weldability is sometimes impaired, so the upper limit of the Ni content is preferably made 2%.

Mo is an element improving the hardenability of the steel and forming carbonitrides to improve the strength. To obtain this effect, the Mo content is preferably made 0.15% or more. On the other hand, if Mo is included in over 0.6%, the strength becomes too high and the low temperature toughness of the HAZ is impaired in some cases, so the upper limit of the Mo content is preferably made 0.6%.

Nb is an element forming carbides and nitrides and improving the strength of the steel. To obtain this effect, the Nb content is preferably made 0.001% or more. On the other hand, if the Nb content is much greater than 0.1%, the low temperature toughnesses of the base material and HAZ are impaired in some cases, so the upper limit of the Nb content is preferably made 0.1%.

Ti is an element effective for deoxidation and forms nitrides to contribute to the increased fineness of the grain size. To obtain this effect, 0.005% or more is preferably added. On the other hand, if the Ti content is much greater than 0.03%, coarse carbides are formed and the low temperature toughness is degraded in some cases, so the upper limit of the Ti content is preferably made 0.03% or less.

Further, one or more of Al, B, N, V, Cu, Cr, Zr, Ta, Ca, REM, and Mg may also be added.

Al is an element effective as a deoxidizing material, but if the Al content exceeds 0.06%, the Al-based nonmetallic inclusions will increase and obstruct the cleanliness of the steel in some cases, so the upper limit of the Al content is preferably made 0.06% or less.

B is an element raising the hardenability and improving the toughness of the weld heat affected zone. To obtain this effect, B is preferably added in an amount of 0.0001% or more. On the other hand, if added in an amount in excess of 0.005%, the toughness sometimes falls. Therefore, the amount of addition of B is preferably made 0.0001 to 0.005% in range.

N forms nitrides with Ti, Al, etc. and prevents the coarsening of the austenite grains of the weld heat affected zone. To obtain this effect, 0.0001% or more of N is preferably added, but if N is added in excess of 0.006%, a drop in the toughness is incurred. Therefore, the amount of addition of N is preferably made 0.0001 to 0.006% in range.

V, like Nb, is an element forming carbides and nitrides and improving the strength of the steel. To obtain this effect, addition of 0.001% or more is preferable. On the other hand, if V is added in an amount over 0.1%, a drop in the toughness is incurred in some cases, so the upper limit is preferably made 0.1% or less.

Cu is an element raising the strength and is preferably added in an amount of 0.01% or more. On the other hand, if adding over 1%, cracks easily occur at the time of heating the steel slab or at the time of welding, so the upper limit is preferably made 1% or less.

Cr is an element improving the strength of the steel by precipitation strengthening and is preferably added in an amount of 0.01% or more. On the other hand, if adding Cr in excess of 0.8%, the toughness is sometimes lowered, so the upper limit is preferably made 0.8% or less.

Zr and T, like Nb, are elements forming carbides and nitrides and improving the strength of the steel and are preferably added in amounts of, respectively, 0.0001% or more. On the other hand, if adding Zr and Ta in amounts over 0.005% respectively, a drop in the toughness is sometimes invited, so the upper limits of the amounts of addition of Zr and Ta are preferably 0.005% or less respectively.

Ca and REM for sulfides, suppress the production of MnS flattened in the rolling direction, and improve the characteristics of the steel material in the plate thickness direction, in particular, the lamellar tear resistance. To obtain this effect, Ca and REM are preferably added in amounts of 0.0001% or more respectively. On the other hand, if adding Ca and REM in amounts over 0.01% respectively, the oxides of Ca and REM increase, so the upper limits of the amounts of addition of Ca and REM are preferably respectively made 0.01% or less.

Mg is an element forming MgO, MgS, and other ultrafine Mg-containing oxides or sulfides, suppressing the coarsening of austenite grains, and improving the HAZ toughness. To obtain this effect, Mg is preferably added in an amount of 0.0001% or more. On the other hand, if adding Mg in an amount over 0.006%, the Mg-containing oxides and sulfides become coarser, so the upper limit is preferably made 0.006% or less.

The high strength welded pipe of the present invention is produced by forming a steel plate into a tubular shape, making the ends abut, and welding the same. Note that the steel pipe is usually shaped by the UO process so that the rolling direction of the steel plate becomes the longitudinal direction of the steel pipe. The texture, microstructure, tensile strength, and precrack DWTT energy at −20° C. of the base material of the steel pipe may be measured using a test piece obtained by pressing the steel pipe into a flat plate shape. If the results are in the above range, the steel pipe can be judged to have the high strength steel plate of the present invention as a base material.

The ingredients of the weld metal of the high strength welded pipe of the present invention are preferably made the following ranges.

C is extremely effective for improving the strength of the steel. To obtain the targeted strength in a martensite structure, the C content is preferably made 0.04% or more. On the other hand, if the C content is over 0.14%, weld low temperature cracking easily occurs and a rise in the highest hardness of the HAZ of the so-called T-cross part where the on-site weld zone and seam weld intersect is invited, so the upper limit of the C content is preferably made 0.14% or less. A more preferable upper limit value of the C content is 0.1% or less.

Si prevents the formation of blow holes, so 0.05% or more is preferably contained. On the other hand, if the Si content is greater than 0.4%, the low temperature toughness is sometimes degraded. In particular, in internal and external welding or multilayer welding, the low temperature toughness of the reheated parts is sometimes degraded, so the upper limit is preferably made 0.4% or less.

Mn is an element improving the balance between the strength and low temperature toughness and forming inclusions forming nuclei for the production of granular bainite. To obtain this effect, the Mn content is preferably made 1.2% or more. On the other hand, if the Mn content is greater than 2.2%, segregation is aided and the low temperature toughness sometimes deteriorates and production of the weld material becomes difficult, so the upper limit of the Mn content is preferably made 2.2% or less.

P and S are unavoidable impurities. They suppress deterioration of the low temperature toughness and reduce the low temperature crack susceptibility, so the P and S contents are preferably made 0.01% or less respectively.

Ni is an element for raising the hardenability, improving the strength, and improving low temperature toughness. To obtain this effect, 1.3% or more of Ni is preferably contained. On the other hand, if the Ni content is greater than 3.2%, high temperature cracking sometimes occurs, so the upper limit of the Ni content is preferably made 3.2% or less.

Cr, Mo, and V are all elements raising the hardenability and improving the strength. To obtain this effect, Cr+Mo+V is preferably made 1% or more. On the other hand, if adding Cr+Mo+V in an amount greater than 2.5%, low temperature cracking sometimes occurs, so the upper limit of the Cr+Mo+V content is preferably made 2.5% or less.

O is an element lower the hardenability and degrading the low temperature toughness of the weld metal. The amount of O is preferably limited to 0.06%. On the other hand, if the amount of O is low, low temperature cracking easily occurs and, simultaneously, the hardness of the on-site weld zone becomes higher in some cases, so the amount is preferably made 0.01% or more.

Further, one or more of Ti, Al, and B may also be contained.

Ti is an element forming nitrides, oxides, etc. of Ti forming nuclei for the formation of granular bainite. It is preferably included in an amount of 0.003% or more. On the other hand, if the Ti content is greater than 0.05%, a large amount of Ti carbides are produced and the low temperature toughness is sometimes degraded, so the upper limit of the Ti content is preferably made 0.05%.

Al sometimes obstructs the formation of oxides of Ti serving as nuclei for the formation of granular bainite, so the Al content is preferably small. The upper limit of the Al content is preferably 0.02% or less. The more preferable upper limit is 0.015% or less.

B is an element raising the hardenability and improving the low temperature toughness of the weld metal, but if the B content is greater than 0.005%, the low temperature toughness is sometimes degraded, so the upper limit of the B content is preferably 0.005% or less. Note that to obtain the effect of improvement of the hardenability and low temperature toughness, B is preferably contained in an amount of 0.0003% or more.

In addition, the weld metal may contain Zr, Nb, Mg, and other elements added to ensure the refining and solidification at the time of welding go well.

The weld metal is mainly comprised of bainite-martensite and granular bainite with the balance of ferrite and/or residual austenite. The tensile strength of the weld metal is preferably higher than that of the base material. To make the tensile strength 770 MPa or more, the area ratio of the bainite-martensite is preferably made 50% or more. Further, to improve the low temperature toughness of the weld metal, the area ratio of the granular bainite is preferably made 10% or more. The bainite-martensite and the granular bainite can be judged by observation of the structure by an optical microscope or scan electron microscope. The area ratios of the bainite-martensite and granular bainite may be measured by image analysis of a structural photograph obtained by an optical microscope or scan electron microscope.

Next, a method of production of high strength steel plate excellent in ductile fracture characteristic of the present invention will be explained. Steel comprised of ingredients within the range of the present invention is produced, then continuously cast. The obtained steel slab is reheated, hot rolled, and cooled to produce steel plate. The hot rolling is comprised of recrystallization rolling performed in the recrystallization temperature range and nonrecrystallization rolling performed in the nonrecrystallization temperature range following that.

To obtain steel plate superior in the ductile fracture characteristic of the present invention, it is necessary to control the {100} accumulation of the steel plate. The structure and rolling ratio at the time of hot rolling, in particular the temperature and rolling ratio of the nonrecrystallization rolling, must be made suitable ranges. In the case of high strength steel plate comprised mainly of bainite and martensite, if rolling the austenite by nonrecrystallization rolling, cooling results in transformation and bainite and martensite where {100} accumulate at the 45° plane of the steel plate is easily obtained. Therefore, if the cumulative rolling ratio at the temperature region where the amount of austenite phase is great is high, the {100} accumulation degree of the 45° plane of the steel plate rises. On the other hand, if ferrite is formed by the nonrecrystallization rolling and cooling, the bainite-martensite decreases and the {100} accumulation degree of the 45° plane of the steel plate falls. Further, the ferrite processed by the nonrecrystallization rolling (referred to as "processed ferrite") has the {100} accumulated at the rolled surface, so the {100} accumulation of the rolled surface greatly depends on the amount of processed ferrite produced. From the above, to suppress the {100} accumulation to the 45° plane of the steel plate, the amount of rolling in the high temperature region where no ferrite is formed may be reduced. Further, to increase the {100} accumulation at the rolled surface, the rolling ratio may be raised after the temperature drops and ferrite is formed. That is, to optimize the texture of the steel plate, it is important to make the conditions of the nonrecrystallization rolling a suitable range, but the microstructure and texture of the steel plate are also affected by the ingredients of the steel and the conditions of the recrystallization rolling etc.

Below, the production conditions for obtaining the high strength steel plate of the present invention will be explained.

The end temperature of the nonrecrystallization rolling has to be made 800° C. or less so as to cause the formation of ferrite effective for improving the ductile fracture characteristic and make the ferrite area ratio 1 to 60%. On the other hand, if less than 600° C., if nonrecrystallization rolling is performed, the shape of the steel plate becomes poor, so the nonrecrystallization rolling has to be ended at 600° C. or more. Note that the preferable upper limit of the end temperature of the nonrecrystallization rolling is 780° C. or less.

If the cumulative rolling ratio at 800° C. or less in the nonrecrystallization rolling is less than 10%, ferrite becomes hard to form, so the lower limit has to be made 10% or more. When the nonrecrystallization rolling is ended at 800° C., the rolling ratio of one pass at 800° C. is made 10% or more. Further, the cumulative rolling ratio of nonrecrystallization rolling is defined as the value of the difference between the plate thickness at 800° C. and the plate thickness at the time of end of nonrecrystallization rolling divided by the plate thickness at 800° C. and expressed as a percentage. Usually, the upper limit is 90% or less. Note that the ferrite formed by the nonrecrystallization rolling is grain boundary ferrite transformed at 650° C. or more, that is, polygonal ferrite.

After the end of the nonrecrystallization rolling, the steel is cooled to over 350° C. by water cooling. At this time, the cooling rate in the range from 600° C. to 450° C. has to be made 0.5° C./s or more. This is because if the cooling rate is less than 0.5° C./s, at the time of the end of the nonrecrystallization region rolling, the previously fine austenite grains grow, the average old austenite grains become over 5 μm in size, and the low temperature toughness drops.

Further, to avoid austenite grain growth, the cooling rate is preferably made 1° C./s or more. On the other hand, the upper limit of the cooling rate is made 10° C./s or less so as to make the ferrite area ratio in the vicinity of the steel plate surface 1% or more. The cooling is performed by water cooling since the cooling rate is easy to control. Further, the water cooling stop temperature is made over 350° C. to prevent the formation of surface parallel cracks. Note that the upper limit of the water cooling stop temperature is preferably made 450° C. or less.

If the reheating temperature of the steel slab is less than 1100° C., the presence of the coarse austenite grains in the solidified structure results in the presence of the same type of coarse grains even after heating, so the increase in fineness becomes insufficient and coarse bainite-martensite grains form at part of the steel plate in some cases. On the other hand, if the reheating temperature exceeds 1250° C., grain growth results in the austenite grains easily becoming coarser, so the grain size of the steel plate as a whole is insufficiently made finer and the low temperature toughness is degraded in some cases. Therefore, the reheating temperature of the steel slab is preferably made 1100 to 1250° C.

If the rolling temperature of the recrystallization rolling becomes less than 900° C., the austenite is not sufficiently recrystallized and the grains are hard to make finer, so the rolling is preferably performed at 900° C. or more. Further, if the average value of the rolling ratios of the passes of the recrystallization rolling is less than 5%, the steel sometimes does not sufficiently recrystallize. Therefore, the average value of the rolling ratio of the passes of the recrystallization rolling is preferably made 5% or more. The upper limit is usually about 20%.

The rolling ratio of the final pass of the recrystallization rolling is preferably 10% or more. This is because recrystallization becomes harder as the rolling temperature falls, so this is to increase the rolling ratio per pass and promote recrystallization. Note that the upper limit of the rolling ratio of the final pass in the recrystallization rolling is preferably as high as possible, but making it over 40% is difficult.

Note that the rolling ratio of each pass is the value of the difference between the plate thickness before and after one rolling pass divided by the plate thickness before rolling and expressed as a percentage. The same is true for the rolling ratio of the final pass. Further, the average value of the rolling ratios of the passes is the value obtained by simply totaling up the rolling ratios of the passes and dividing the sum by the number of passes.

Following the recrystallization rolling, the grains are further flattened and reduced in size by nonrecrystallization rolling.

If the temperature of the nonrecrystallization rolling exceeds 880° C., the temperature near the center of the plate thickness rises due to the rolling. If the recrystallization temperature is exceeded, the grains will grow and the increase in grain fineness may become insufficient. Further, if the cumulative amount of rolling of the nonrecrystallization rolling is less than 60%, the grain size becomes difficult to make finer. Therefore, the temperature range of the nonrecrystallization rolling is preferably made 880° C. or less and the cumulative rolling ratio is preferably made 60% or more. Note that the cumulative rolling ratio of nonrecrystallization rolling is the difference between the plate thickness before nonrecrystallization rolling, that is, after the end of recrystallization rolling, and the plate thickness after the end of nonrecrystallization rolling divided by the plate thickness before nonrecrystallization rolling and expressed as a percentage. Further, to suppress the {100} accumulation degree of the 45° plane, the cumulative rolling ratio at 800° C. or less in the cumulative rolling ratio of nonrecrystallization rolling is preferably made larger than the following cumulative rolling ratio.

The high strength steel plate obtained by the above production conditions is press formed into a tubular shape and the ends are made to abut against each other and welded by submerged arc welding to obtain high strength welded pipe. Submerged arc welding is welding with a large dilution by the base material. To obtain the desired characteristics, that is, the weld metal composition, a welding material must be selected considering the dilution by the base material. Below, the reasons for limitation of the chemical composition of the welding wire will be explained, but basically this is a method of production enabling high strength line pipe to be realized.

The content of C was made 0.01 to 0.12%, considering the dilution by the ingredients of the base material and entry of C from the surroundings, to obtain the C content of the range required by the weld metal.

The contents of Si, Mn, Ni, and Cr+Mo+V were made, respectively, 0.3% or less, 1.2 to 2.4%, 4 to 8.5%, and 3 to 5%, considering the dilution by the ingredients of the base metal, to obtain the contents of Si, Mn, Ni, and Cr+Mo+V of the ranges required by the weld metal.

Ti is an element forming nitrides and oxides etc. of Ti forming nuclei for formation of granular bainite and is preferably contained in an amount of 0.005% or more. On the other hand, if the Ti content is too much greater than 0.15%, Ti carbides are formed in large amounts and the low temperature toughness is sometimes degraded, so the upper limit of the Ti content is preferably made 0.15%.

Al sometimes obstructs the formation of Ti oxides forming nuclei for formation of granular bainite, so the Al content is preferably small. The preferable upper limit of the Al content is 0.02% or less.

B secures strength, so may be added in an amount of 0.0003 to 0.005% or so. In addition, the P, S impurities are preferably extremely small in content. Further, Zr, Nb, Mg, etc. are used for the purpose of deoxidation.

Note that the welding is not limited to a single electrode. Welding by a plurality of electrodes is also possible. In the case of welding by a plurality of electrodes, various types of wires can be combined. The individual wires need not be in the above range of ingredients. It is sufficient that the average composition from the different wire ingredients and the amounts consumed be in the above range of ingredients.

The flux used for submerged arc welding may be roughly divided into sintered flux and molten flux. Sintered flux has the advantage that a hydrogen alloy material can be added and the amount of diffusible hydrogen is low, but has the disadvantage that it easily crumbles to a powder and repeated use is difficult. On the other hand, molten flux has the advantage that it is a glass powder in form, has a high particle strength, and is resistant to moisture absorption, but has the disadvantage that the diffusible hydrogen is somewhat high. When producing the high strength steel of the present invention pipe, weld low temperature cracking easily occurs. From this viewpoint, the sintered type is preferable, but on the other hand the molten type, which can be recovered and repeatedly used, has the advantage of being suitable for mass production and being low in cost. With the sintered type, the cost is high, but with the molten type, the need for strict quality control is a problem, but this is in a range which can be industrially handled. Both types can inherently be used.

Next, the welding conditions will be explained below:

The initially performed tack welding may be by any of MAG arc welding, MIG arc welding, or TIG arc welding. Usually, it is MAG arc welding. In particular, the internal and external weldings are preferably made submerged arc welding, but may also be TIG arc welding, MIG arc welding, or MAG arc welding. The internal and external weldings may be performed respectively by single passes, but may also be performed by a plurality of passes.

The specific heat input of the internal and external surfaces per 1 mm of plate thickness of the submerged arc welding is preferably made 0.13 to 0.25 kJ/mm$^2$. This range corresponds to a welding heat input of the internal and external surfaces of a plate thickness of 15 mm of 2 to 3.8 kJ/mm. If the specific heat input of the internal and external surfaces per 1 mm of plate thickness of the submerged arc welding is less than 0.13 kJ/mm$^2$, the heat input is too small, the penetration becomes insufficient, the number of welding operations increases, and the work efficiency deteriorates in some cases. On the other hand, if the specific heat input of the internal and external surfaces per 1 mm of plate thickness of submerged arc welding is larger than 0.25 kJ/mm$^2$, the heat affected zone softens and the weld zone drops in toughness in some cases. Note that when the weld zones of the tack welding and internal and external welding overlap, the welding heat input is preferably as low as possible.

When welding the internal and external surfaces by submerged arc welding, if making the welding rate less than 1 m/min, the welding is extremely inefficient as seam welding for line pipe, while if over 3 m/min, the bead shape sometimes becomes unstable. Therefore, the welding rate of submerged arc welding is preferably 1 to 3 m/min in range.

After seam welding, the pipe is preferably expanded to improve its circularity. To improve the circularity, deformation until the plastic region is necessary. In the case of the high strength steel pipe of the present invention, the expansion rate, comprising the value of the difference between the circumference after expansion and the circumference before expansion divided by the circumference before expansion expressed by a percentage, is preferably 0.5% or more. On the other hand, if the expansion rate is over 2%, both the base material and weld zone sometimes deteriorate in toughness due to plastic deformation. Therefore, the expansion rate is preferably made 0.5 to 2% in range.

EXAMPLES

Example 1

Steel containing C: 0.11%, Si; 0.25%, Mn: 1.5%, P: 0.01%, and S: 0.002% was produced and cast into steel slabs. The steel slabs were reheated and rolled by recrystallization rolling and nonrecrystallization rolling, then were water cooled to produce steel plates having a plate thickness of 20 mm. The steel plates of the present invention were produced under the following conditions. That is, nonrecrystallization rolling was performed with an end temperature of 600 to 800° C. in range and with a cumulative rolling ratio at 800° C. or less of 10% or more, and the water cooling was performed with an average cooling rate from 600° C. to 450° C. of 0.5 to 10° C./s and stopped in a temperature range of over 350° C. to less than 450° C. On the other hand, the steel plate of the comparative example was rolled with an end temperature of the nonrecrystallization rolling of over 800° C.

A 300 mm square test piece was taken from each steel plate and inspected by ultrasonic flaw detection based on JIS Z 2234 at a frequency of 5 MPa by vertical flaw detection. It was confirmed that each steel plate had a measurement value of less than 1 mm and that surface parallel cracks were not caused. The test piece was taken so that the plate thickness cross-section of the rolling direction of the steel plate became the observed surface, was polished and etched, then the microstructure was observed by an optical microscope. A structural photograph taken near the vicinity of the center of the plate thickness was analyzed by image analysis to find the ferrite area ratio and the ferrite grain size. Further, test pieces having cross-sections rotated by 5° intervals in the range of 20 to 50° from the plate thickness cross-section about the axis of the rolling direction as the measurement surface were taken from the steel plate and inspected by X-ray diffraction. The maximum values were made the {100} accumulation degree of the 45° plane. The samples for X-ray diffraction were obtained with a thickness of 2 mm and a maximum size of 30 mm so that the measurement points became close to the center in the plate thickness. Further, test pieces were taken using the width direction of the steel plate as the longitudinal direction and inspected by a precrack DWTT test at −20° C. to find the precrack DWTT energy.

The results are shown in Table 1. In Table 1, the ferrite percentage is the area ratio of the ferrite, E is the precrack DWTT energy at −20° C., and the 45° plane {100} is the {100} accumulation degree of the 45° plane of the steel plate. The steel plates of the present invention had an area ratio of ferrite of 1 to 60% in range. Each had a {100} accumulation degree of the 45° plane of less than 3, a precrack DWTT energy at −20° C. of 3000 J or more, and an excellent ductile fracture characteristic. However, the steel plate of the comparative example did not have ferrite formed, had a {100} accumulation degree of the 45° plane of over 3, had a precrack DWTT energy of the base material of less than 3000 J, and had a good ductile fracture characteristic.

TABLE 1

| Sample no. | Ferrite fraction % | E J | 45° plane {100} | Ferrite grain size μm | Remarks |
|---|---|---|---|---|---|
| 1 | 3 | 3100 | 2.8 | 4.5 | Inv. |
| 2 | 10 | 4000 | 2.7 | 4.1 | example |
| 3 | 30 | 4500 | 2.5 | 3.8 | |
| 4 | 50 | 5000 | 2.0 | 4.6 | |
| 5 | 60 | 3050 | 2.4 | 5.3 | |
| 6 | 0 | 2000 | 3.5 | — | Comp. ex. |

Example 2

Steels containing the ingredients shown in Table 2 were produced and cast to form steel slabs of thicknesses of 240 mm. These steel slabs were rolled under the conditions shown in Table 3 to obtain steel plates of plate thicknesses of 14 to 25 mm. The obtained steel plates were press formed into tubular shapes and tack welded, then welding wires comprised of steels containing the ingredients shown in Table 4 were used to weld the internal and external surfaces by submerged arc welding by the conditions shown in Table 4, then the tubes were expanded by an expansion rate of 2% or less to produce 36 inch (913 mm diameter) steel pipes. Samples were taken from the seam weld zones and analyzed for ingredients of the weld metal. Table 5 shows the ingredients contained in the weld metal.

The obtained steel pipes were cut and pressed to flat plate shapes, then samples were taken and the microstructures and textures were investigated. The samples were polished and etched and then observed for structure by an optical microscope. The microstructures were observed by an optical microscope. The samples were taken so that the thickness cross-sections in the longitudinal directions of the steel pipes became the observed surfaces. The observed surfaces were polished and etched. Optical micrographs of the structures were analyzed by image analysis to measure the area ratio and grain size of the ferrite. Further, the textures were investigated by X-ray diffraction. The samples for measurement of the 45° plane {100} accumulation degree were taken so that the planes rotated by 5° intervals in the range of 20 to 50° from the plate thickness cross-section about the axis of the longitudinal direction of the steel pipe became the measurement surfaces. Further, the samples for measurement of the {100} accumulation degree of the rolled surface were obtained so that the plane near the center of thickness parallel to the surface of the base material of the steel pipe pressed in a flat plate shape became the measurement surface. The samples for X-ray diffraction were taken with a thickness of 2 mm and a maximum diameter of 30 mm so that the measurement points became near the center of plate thickness. Further, 300 mm square test pieces were obtained from the base material of the steel pipe pressed into a flat plate shape and inspected by ultrasonic fault detection based on JIS Z 2234 at a frequency of 5 MPa by vertical fault detection. Pieces where the result of the ultrasonic fault detection was that the measurement values of the long axes of the faults were all less than 1 mm were evaluated as having no surface parallel cracks, while ones having faults with measurement value of 1 mm or more were evaluated as having surface parallel cracks.

Further, No. 2 tensile test pieces were taken from the base material of the steel pipe using the circumferential direction as the longitudinal direction based on JIS Z 2240 so that the vicinity of the center of plate thickness became the parallel part of the test piece. The tensile test of the weld metal was conducted in accordance with JIS Z 3111 using a No. A2 tensile test piece.

Further, the steel pipes were pressed into flat plate shapes and DWTT test pieces were taken so that the circumferential direction became the longitudinal direction. Press notches were introduced in the thickness direction, ductile cracks were introduced by three-point bending, and precrack DWTT tests were run at −20° C. Further, the steel pipes were pressed into flat plate shapes, test pieces were taken so that the circumferential direction became the longitudinal direction, a Charpy impact test was conducted in accordance with JIS Z 2242, and the Charpy absorption energy of the base material at −40° C. was measured. The impact test of the weld metal was conducted in accordance with JIS Z 3111 at −30° C. The Charpy impact test pieces of the weld heat affected zones were obtained so that the circumferential direction of the steel pipe became the longitudinal direction of the Charpy impact test pieces. The thickness cross-sections of the test pieces were polished to confirm the intersections of the weld metal of the external surface and the weld metal of the internal surface, then V-notches were introduced by machining at positions 2 mm away from the intersections to the weld heat affected zone side. A Charpy impact test of the weld heat affected zone was conducted in accordance with JIS Z 2242 at −30° C.

Further, the insides of the steel pipes were filled with water and a gas and burst to determine if the cracks formed stopped or propagated and ran through the steel pipes in the longitudinal direction for a partial burst test.

Table 6 shows the test results. The ferrite fraction of Table 6 is the area ratio of the ferrite, TS is the tensile strength, E is the precrack DWTT energy at −20° C., YS is the yield strength, YR is the yield ratio, vE is the Charpy absorption energy, the suffixes show the measurement temperature, and HAZ means the weld heat affected zone. In Table 6, Example Nos. 1 to 11 are examples of the present invention. These steel pipes all had a base material −20° C. precrack DWTT energy of 3000 J or more. Further, in the partial gas burst tests, the cracks stopped and the ductile fracture characteristics were superior.

On the other hand, Example Nos. 12 to 20 are comparative examples and do not have ferrite formed. As a result, the 45° plane {100} accumulation degree exceeded 3 and the base material precrack DWTT energy was less than 3000 J. Further, due to these poor characteristics, in the partial gas burst tests, the cracks ran through the pieces, and the ductile fracture characteristics were also inferior. Further, Example Nos. 19 and 20 had water cooling stop temperatures of 350° C. or less, so surface parallel cracks formed and the precrack DWTT energy dropped.

TABLE 2

| Steel no. | C | Si | Mn | P | S | Ni | Mo | Nb | Ti | Al | N | B | V | Cu | Cr | Others | Remarks |
|---|---|---|---|---|---|---|---|---|---|---|---|---|---|---|---|---|---|
| A | 0.08 | 0.15 | 1.85 | 0.011 | 0.0003 | 0.38 | 0.34 | 0.029 | 0.013 | 0.020 | 0.0025 | 0.0008 | 0.059 | 0.10 | 0.45 | — | Inv. |
| B | 0.06 | 0.25 | 1.93 | 0.006 | 0.0007 | 0.85 | 0.2 | 0.025 | 0.017 | 0.012 | 0.0032 | 0 | 0.041 | 0.23 | 0.45 | Ca: 0.0025 | ex. |
| C | 0.05 | 0.05 | 1.56 | 0.006 | 0.0005 | 1.51 | 0.34 | 0.015 | 0.015 | 0.047 | 0.0028 | 0.0010 | 0.049 | 0 | 0.40 | — | |
| D | 0.03 | 0.20 | 2.24 | 0.009 | 0.0020 | 0.37 | 0.46 | 0.005 | 0.012 | 0.016 | 0.0041 | 0 | 0.079 | 0.75 | 0.61 | Mg: 0.002 | |
| E | 0.06 | 0.09 | 1.78 | 0.009 | 0.0010 | 0.56 | 0.35 | 0.010 | 0.020 | 0.020 | 0.0020 | 0.0012 | 0.030 | 0 | 0 | Zr: 0.005 | |
| F | 0.05 | 0.15 | 2.00 | 0.007 | 0.0006 | 0.45 | 0.52 | 0.050 | 0.016 | 0.026 | 0.0035 | 0 | 0 | 0 | 0 | Ta: 0.005 | |
| G | 0.04 | 0.34 | 1.95 | 0.009 | 0.0007 | 0.65 | 0.15 | 0.020 | 0.013 | 0.011 | 0.0010 | 0.0015 | 0.060 | 0.23 | 0 | REM: 0.005 | |
| H | 0.06 | 0.20 | 1.90 | 0.010 | 0.0020 | 0.40 | 0.3 | 0.030 | 0.015 | 0.007 | 0.0030 | 0 | 0 | 0.40 | 0 | Mg: 0.0010 | |
| I | 0.16 | 0.47 | 2.13 | 0.010 | 0.0011 | 0 | 0.13 | 0.034 | 0.018 | 0.021 | 0.0029 | 0.0013 | 0 | 0 | 0 | — | |
| J | 0.02 | 0.15 | 2.05 | 0.012 | 0.0007 | 0.53 | 0.46 | 0.015 | 0.018 | 0.018 | 0.0025 | 0.0010 | 0.032 | 0.12 | 0 | — | |

TABLE 3

| Sample no. | Steel plate no. | Reheat Heating temp. ° C. | Recrystallization rolling End temp. ° C. | Average pass rolling ratio % | Final pass rolling ratio % | Plate thickness mm | Nonrecrystallization rolling Start temp. ° C. | End temp. ° C. | Cumulative rolling ratio % | Cumulative rolling ratio (800° C. or less) % | Water cooling Stop temp. ° C. | Cooling rate ° C./s | Thickness of steel plate mm | Remarks |
|---|---|---|---|---|---|---|---|---|---|---|---|---|---|---|
| 1 | A | 1150 | 950 | 7 | 11 | 80 | 830 | 640 | 80 | 35 | 410 | 10 | 16 | Inv. ex. |
| 2 | A | 1150 | 960 | 8 | 13 | 85 | 840 | 700 | 85 | 25 | 360 | 9 | 15 | |
| 3 | B | 1100 | 980 | 10 | 12 | 90 | 850 | 650 | 83 | 12 | 420 | 8 | 15 | |
| 4 | C | 1150 | 930 | 8 | 14 | 100 | 820 | 660 | 86 | 25 | 370 | 9 | 14 | |
| 5 | D | 1150 | 910 | 5 | 15 | 70 | 840 | 670 | 73 | 15 | 380 | 5 | 19 | |
| 6 | E | 1150 | 900 | 8 | 20 | 80 | 850 | 680 | 75 | 30 | 410 | 4 | 20 | |
| 7 | F | 1100 | 920 | 13 | 11 | 90 | 820 | 650 | 84 | 16 | 380 | 3 | 14 | |
| 8 | G | 1150 | 940 | 9 | 13 | 100 | 810 | 650 | 80 | 23 | 430 | 4 | 20 | |
| 9 | H | 1150 | 920 | 6 | 14 | 110 | 860 | 700 | 77 | 16 | 450 | 5 | 25 | |
| 10 | H | 1100 | 910 | 7 | 10 | 80 | 850 | 750 | 80 | 15 | 390 | 6 | 16 | |
| 11 | H | 1150 | 930 | 6 | 13 | 100 | 840 | 770 | 80 | 10 | 450 | 8 | 20 | |
| 12 | A | 1000 | 950 | 9 | 14 | 110 | 800 | 790 | 85 | 2 | 440 | 5 | 16 | Comp. ex. |
| 13 | B | 1200 | 850 | 5 | 12 | 95 | 830 | 780 | 84 | 4 | 360 | 6 | 15 | |
| 14 | C | 1050 | 920 | 8 | 11 | 80 | 950 | 850 | 83 | 0 | 370 | 4 | 14 | |
| 15 | D | 1100 | 910 | 6 | 10 | 49 | 840 | 770 | 49 | 5 | 380 | 5 | 25 | |
| 16 | A | 1100 | 920 | 6 | 13 | 80 | 850 | 780 | 80 | 4 | 360 | 40 | 16 | |
| 17 | I | 1150 | 930 | 7 | 14 | 95 | 820 | 700 | 83 | 9 | 420 | 9 | 16 | |
| 18 | J | 1200 | 930 | 4 | 15 | 100 | 880 | 680 | 79 | 9 | 400 | 60 | 21 | |
| 19 | B | 1150 | 920 | 8 | 3 | 80 | 870 | 840 | 76 | 0 | 150 | 10 | 19 | |
| 20 | C | 1200 | 950 | 7 | 14 | 70 | 860 | 650 | 80 | 3 | 100 | 8 | 14 | |

TABLE 4

| Sample no. | Steel no. | Ingredients (mass %) C | Si | Mn | Ni | Cr + Mo + V | Ti | Al | Flux | Heat input kJ/mm | Specific heat input kJ/mm$^2$ | Remarks |
|---|---|---|---|---|---|---|---|---|---|---|---|---|
| 1 | A | 0.041 | 0.21 | 1.73 | 4.9 | 4.3 | 0.005 | 0.012 | Molten type | 2.8 | 0.18 | Inv. ex. |
| 2 | A | 0.045 | 0.15 | 1.70 | 5.3 | 4.0 | 0.008 | 0.011 | Molten type | 2.4 | 0.16 | |
| 3 | B | 0.051 | 0.12 | 1.85 | 5.7 | 3.9 | 0.010 | 0.010 | Molten type | 2.0 | 0.13 | |
| 4 | C | 0.082 | 0.35 | 2.20 | 5.4 | 3.5 | 0.020 | 0.015 | Molten type | 2.2 | 0.16 | |
| 5 | D | 0.075 | 0.15 | 1.66 | 6.5 | 4.1 | 0.015 | 0.010 | Sintered type | 3.0 | 0.16 | |
| 6 | E | 0.066 | 0.15 | 1.85 | 5.7 | 3.9 | 0.100 | 0.008 | Sintered type | 2.5 | 0.13 | |
| 7 | F | 0.061 | 0.21 | 1.66 | 6.5 | 4.1 | 0.030 | 0.005 | Molten type | 2.0 | 0.14 | |
| 8 | G | 0.032 | 0.25 | 1.75 | 2.1 | 3.7 | 0.050 | 0.009 | Molten type | 3.5 | 0.18 | |
| 9 | H | 0.049 | 0.15 | 1.85 | 5.7 | 3.9 | 0.010 | 0.010 | Molten type | 4.0 | 0.16 | |
| 10 | H | 0.065 | 0.30 | 1.70 | 5.4 | 3.5 | 0.011 | 0.015 | Molten type | 2.5 | 0.16 | |
| 11 | H | 0.070 | 0.18 | 1.66 | 5.1 | 4.1 | 0.013 | 0.010 | Sintered type | 3.0 | 0.15 | |
| 12 | A | 0.074 | 0.29 | 1.76 | 5.7 | 4.0 | 0.020 | 0.012 | Molten type | 2.5 | 0.16 | Comp. ex. |
| 13 | B | 0.078 | 0.15 | 1.85 | 8.6 | 4.5 | 0.080 | 0.018 | Molten type | 2.3 | 0.15 | |
| 14 | C | 0.056 | 0.21 | 1.66 | 6.5 | 4.1 | 0.030 | 0.012 | Molten type | 2.4 | 0.17 | |
| 15 | D | 0.056 | 0.18 | 2.01 | 6.1 | 3.8 | 0.090 | 0.013 | Sintered type | 5.0 | 0.20 | |
| 16 | A | 0.065 | 0.12 | 1.85 | 6.5 | 4.1 | 0.040 | 0.015 | Molten type | 2.2 | 0.14 | |
| 17 | I | 0.050 | 0.15 | 1.96 | 5.1 | 3.5 | 0.100 | 0.012 | Sintered type | 2.7 | 0.17 | |
| 18 | J | 0.051 | 0.12 | 1.85 | 5.7 | 3.9 | 0.010 | 0.010 | Molten type | 3.6 | 0.17 | |
| 19 | B | 0.082 | 0.35 | 2.20 | 5.4 | 3.5 | 0.020 | 0.015 | Molten type | 2.4 | 0.13 | |
| 20 | C | 0.075 | 0.15 | 1.66 | 6.5 | 4.1 | 0.015 | 0.010 | Sintered type | 2.6 | 0.19 | |

TABLE 5

| Sample no. | Steel no. | Ingredients (mass %) C | Si | Mn | P | S | Ni | Cr + Mo + V | O | Ti | Al | B | Others | Remarks |
|---|---|---|---|---|---|---|---|---|---|---|---|---|---|---|
| 1 | A | 0.061 | 0.26 | 1.68 | 0.008 | 0.002 | 2.4 | 1.9 | 0.015 | 0.017 | 0.013 | 0.0009 | — | Inv. ex. |
| 2 | A | 0.055 | 0.20 | 1.65 | 0.007 | 0.003 | 2.6 | 2 | 0.018 | 0.015 | 0.014 | 0.0005 | — | |
| 3 | B | 0.075 | 0.14 | 1.82 | 0.006 | 0.003 | 2.8 | 1.8 | 0.020 | 0.009 | 0.017 | 0.0003 | — | |
| 4 | C | 0.065 | 0.12 | 1.97 | 0.008 | 0.004 | 2.9 | 1.7 | 0.025 | 0.010 | 0.018 | 0.0020 | — | |
| 5 | D | 0.065 | 0.09 | 1.85 | 0.008 | 0.003 | 2.1 | 2.4 | 0.024 | 0.011 | 0.017 | 0.0003 | Zr: 0.012 | |

TABLE 5-continued

| Sample no. | Steel no. | Ingredients (mass %) C | Si | Mn | P | S | Ni | Cr + Mo + V | O | Ti | Al | B | Others | Remarks |
|---|---|---|---|---|---|---|---|---|---|---|---|---|---|---|
| 6 | E | 0.075 | 0.19 | 1.91 | 0.007 | 0.003 | 2.2 | 2.1 | 0.030 | 0.013 | 0.022 | 0.0011 | — | |
| 7 | F | 0.071 | 0.24 | 1.76 | 0.007 | 0.002 | 3.1 | 2.1 | 0.026 | 0.007 | 0.012 | 0.0005 | Nb: 0.0015 | |
| 8 | G | 0.056 | 0.28 | 1.86 | 0.008 | 0.003 | 1.2 | 1.8 | 0.019 | 0.014 | 0.015 | 0.0014 | — | |
| 9 | H | 0.075 | 0.13 | 1.82 | 0.006 | 0.003 | 2.8 | 1.8 | 0.020 | 0.009 | 0.017 | 0.0003 | — | |
| 10 | H | 0.065 | 0.12 | 1.97 | 0.008 | 0.004 | 2.9 | 1.7 | 0.025 | 0.010 | 0.018 | 0.0020 | — | |
| 11 | H | 0.050 | 0.09 | 1.85 | 0.008 | 0.003 | 2.1 | 2.4 | 0.024 | 0.011 | 0.017 | 0.0003 | — | |
| 12 | A | 0.090 | 0.30 | 1.84 | 0.009 | 0.002 | 3.2 | 1.9 | 0.020 | 0.012 | 0.019 | 0.0017 | — | Comp. ex. |
| 13 | B | 0.078 | 0.21 | 1.95 | 0.007 | 0.002 | 5.1 | 2.1 | 0.025 | 0.013 | 0.016 | 0.0006 | — | |
| 14 | C | 0.065 | 0.35 | 1.88 | 0.008 | 0.004 | 2.8 | 1.6 | 0.016 | 0.013 | 0.014 | 0.0012 | — | |
| 15 | D | 0.056 | 0.25 | 1.85 | 0.008 | 0.003 | 3.2 | 1.9 | 0.020 | 0.012 | 0.015 | 0.0005 | — | |
| 16 | A | 0.065 | 0.19 | 1.91 | 0.009 | 0.004 | 2.5 | 1.8 | 0.022 | 0.010 | 0.016 | 0.0007 | — | |
| 17 | I | 0.065 | 0.25 | 1.26 | 0.005 | 0.002 | 2.4 | 1.5 | 0.023 | 0.012 | 0.023 | 0.0005 | — | |
| 18 | J | 0.075 | 0.14 | 1.82 | 0.006 | 0.003 | 2.8 | 1.8 | 0.020 | 0.009 | 0.017 | 0.0003 | — | |
| 19 | B | 0.065 | 0.12 | 1.97 | 0.008 | 0.004 | 2.9 | 1.7 | 0.025 | 0.010 | 0.018 | 0.0020 | — | |
| 20 | C | 0.065 | 0.09 | 1.85 | 0.008 | 0.003 | 2.1 | 2.4 | 0.024 | 0.011 | 0.017 | 0.0003 | — | |

TABLE 6

| Sample no. | Steel plate no. | Microstructure: Ferrite fraction % | Ferrite grain size μm | {100} accumulation degree: 45° plane | Rolled surface | Surface parallel cracks | Mechanical characteristics of base material: TS MPa | E J | YS MPa | YR % | vE-40 J | Partial burst test | Weld metal: vE-30 J | TS MPa | HAZ: vE-30 J | Remarks |
|---|---|---|---|---|---|---|---|---|---|---|---|---|---|---|---|---|
| 1 | A | 3 | 4.8 | 2.5 | 1.8 | No | 800 | 5500 | 700 | 88 | 230 | Arrested | 150 | 964 | 80 | Inv. |
| 2 | A | 4 | 4.0 | 2.8 | 1.9 | No | 790 | 5600 | 700 | 89 | 245 | Arrested | 145 | 975 | 85 | ex. |
| 3 | B | 20 | 4.5 | 2.2 | 3.2 | No | 790 | 5300 | 670 | 85 | 235 | Arrested | 130 | 1020 | 90 | |
| 4 | C | 4 | 3.5 | 2.0 | 1.9 | No | 850 | 5000 | 740 | 87 | 240 | Arrested | 140 | 1012 | 110 | |
| 5 | D | 20 | 3.7 | 2.1 | 3.0 | No | 820 | 4700 | 690 | 84 | 236 | Arrested | 150 | 998 | 90 | |
| 6 | E | 3 | 4.0 | 1.9 | 1.8 | No | 850 | 3900 | 760 | 89 | 243 | Arrested | 110 | 1050 | 95 | |
| 7 | F | 25 | 3.9 | 2.6 | 3.0 | No | 790 | 4900 | 710 | 90 | 245 | Arrested | 120 | 1057 | 85 | |
| 8 | G | 2 | 4.3 | 2.4 | 1.8 | No | 820 | 5600 | 720 | 88 | 240 | Arrested | 170 | 986 | 90 | |
| 9 | H | 10 | 3.2 | 2.4 | 2.4 | No | 760 | 6300 | 700 | 92 | 230 | Arrested | 150 | 800 | 90 | |
| 10 | H | 8 | 3.2 | 2.3 | 2.3 | No | 830 | 6500 | 750 | 90 | 250 | Arrested | 140 | 810 | 80 | |
| 11 | H | 11 | 4.0 | 2.4 | 2.4 | No | 810 | 7500 | 730 | 90 | 260 | Arrested | 130 | 830 | 85 | |
| 12 | A | 0 | — | 3.5 | 1.3 | No | 770 | 2000 | 700 | 91 | 80 | Run thru | 140 | 1023 | 90 | Comp. |
| 13 | B | 0 | — | 3.4 | 1.5 | No | 820 | 2500 | 760 | 93 | 100 | Run thru | 140 | 990 | 100 | ex. |
| 14 | C | 0 | — | 3.3 | 1.3 | No | 800 | 2300 | 730 | 91 | 136 | Run thru | 120 | 1023 | 90 | |
| 15 | D | 0 | — | 3.5 | 1.4 | No | 750 | 2300 | 700 | 93 | 85 | Run thru | 100 | 950 | 100 | |
| 16 | A | 0 | — | 3.1 | 1.3 | No | 800 | 2100 | 700 | 88 | 80 | Run thru | 130 | 1045 | 85 | |
| 17 | I | 0 | — | 3.1 | 1.4 | No | 1260 | 2000 | 1150 | 91 | 80 | Run thru | 120 | 1050 | 25 | |
| 18 | J | 0 | — | 3.1 | 1.2 | No | 830 | 2300 | 760 | 92 | 200 | Run thru | 130 | 950 | 80 | |
| 19 | B | 0 | — | 3.3 | 1.4 | Yes | 850 | 2900 | 780 | 92 | 230 | Run thru | 150 | 1000 | 90 | |
| 20 | C | 0 | — | 3.2 | 1.5 | Yes | 870 | 2800 | 800 | 92 | 240 | Run thru | 140 | 990 | 85 | |

INDUSTRIAL APPLICABILITY

According to the present invention, it is possible to provide high strength steel plate and high strength welded pipe excellent in ductile fracture characteristic with a tensile strength corresponding to the X100 class of the API standard and methods of production of the same.

The invention claimed is:

1. A high strength cold-formed welded pipe excellent in ductile fracture characteristic, by containing, by mass %, C: 0.01 to 0.5%, Si: 0.01 to 3%, Mn: 0.1 to 5%, P: 0.03% or less, and S: 0.03% or less, and a balance of Fe and unavoidable impurities, having a two-phase microstructure containing, by area ratio, more than 5% to no more than 20% of a first phase of ferrite and a balance of a second phase of bainite and martensite, having a maximum value of a {100} accumulation degree of a cross-section rotated 20 to 50° from a plate thickness cross-section about the axis of the rolling direction of 3 or less, and having thickness parallel cracks measured by ultrasonic flaw detection of less than 1 mm.

2. A high strength cold-formed welded pipe excellent in ductile fracture characteristic as set forth in claim 1, characterized by further containing, by mass %, Ni: 0.1 to 2%, Mo: 0.15 to 0.6%, Nb: 0.001 to 0.1%, and Ti: 0.005 to 0.03%.

3. A high strength cold-formed welded pipe excellent in ductile fracture characteristic as set forth in claim 1, characterized by further containing, by mass %, one or more of Al: 0.06% or less, B: 0.0001 to 0.005%, N: 0.0001 to 0.006%, V: 0.001 to 0.1%, Cu: 0.01 to 1%, Cr: 0.01 to 0.8%, Zr: 0.0001 to 0.005%, Ta: 0.0001 to 0.005%, Ca: 0.0001 to 0.01%, REM: 0.0001 to 0.01%, and Mg: 0.0001 to 0.006%.

4. A high strength cold-formed welded pipe excellent in ductile fracture characteristic as set forth in claim 1, characterized in that an average grain size of the ferrite is 5 μm or less.

5. A high strength cold-formed welded pipe excellent in ductile fracture characteristic as set forth in claim 1, characterized in that a {100} accumulation degree of the rolled surface is 1.6 to 7.

6. A high strength cold-formed welded pipe excellent in ductile fracture characteristic as set forth in claim 1, characterized in that the tensile strength TS is 760 to less than 900 MPa, a precrack DWTT energy E at −20° C. is 3000 to 9000 J, and TS and E satisfy the following equation (1):

$$20000 \leq 20TS + E \leq 25000 \quad (1).$$

7. A high strength cold-formed welded pipe excellent in ductile fracture as set forth in claim 1, characterized in that a seam welding metal contains as ingredients, by mass %, C: 0.04 to 0.14%, Si: 0.05 to 0.4%, Mn: 1.2 to 2.2%, P: 0.01% or less, S: 0.01% or less, Ni: 1.3 to 3.2%, Cr+Mo+V: 1 to 2.5%, and O: 0.01 to 0.06% and further one or more of Ti: 0.003 to 0.05%, Al: 0.02% or less, and B: 0.005% or less and a balance of Fe and unavoidable impurities.

8. A high strength cold-formed welded pipe excellent in ductile fracture as set forth in claim 1, containing, by mass %, C: 0.04 to 0.14%, Si: 0.05 to 0.6%, Mn: 1.5 to 2.5%, P: 0.015% or less, and S: 0.003% or less, and one or more of Ni: 0.1 to 2%, Mo: 0.15 to 0.6%, Nb: 0.001 to 0.1%, Ti: 0.003 to 0.05%.

* * * * *

UNITED STATES PATENT AND TRADEMARK OFFICE

CERTIFICATE OF CORRECTION

PATENT NO. : 8,715,430 B2
APPLICATION NO. : 11/887885
DATED : May 6, 2014
INVENTOR(S) : Takuya Hara et al.

It is certified that error appears in the above-identified patent and that said Letters Patent is hereby corrected as shown below:

In the Specification

Column 5, line 53, change "(100)" to -- {100} --;

Column 6, line 38, change "(100)" to -- {100} --;

Column 6, line 41, change "(100)" to -- {100} --.

Signed and Sealed this
Fourteenth Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,715,430 B2
APPLICATION NO. : 11/887885
DATED : May 6, 2014
INVENTOR(S) : Hara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1165 days.

Signed and Sealed this
Twenty-ninth Day of September, 2015

Michelle K. Lee

Michelle K. Lee
*Director of the United States Patent and Trademark Office*